US012023774B2

(12) United States Patent
Fan et al.

(10) Patent No.: US 12,023,774 B2
(45) Date of Patent: Jul. 2, 2024

(54) APPARATUS AND METHOD FOR POLISHING INTRAOCULAR LENS BY UTILIZING ELECTRORHEOLOGICAL EFFECT

(71) Applicant: Soochow University, Suzhou (CN)

(72) Inventors: Cheng Fan, Suzhou (CN); Lei Zhang, Suzhou (CN); Yucheng Xue, Suzhou (CN); Qian Wang, Suzhou (CN); Kejun Wang, Suzhou (CN)

(73) Assignee: Soochow University, Suzhou (CN)

( * ) Notice: Subject to any disclaimer, the term of this patent is extended or adjusted under 35 U.S.C. 154(b) by 376 days.

(21) Appl. No.: 17/753,526

(22) PCT Filed: Oct. 13, 2020

(86) PCT No.: PCT/CN2020/120644
§ 371 (c)(1),
(2) Date: Mar. 7, 2022

(87) PCT Pub. No.: WO2021/169316
PCT Pub. Date: Sep. 2, 2021

(65) Prior Publication Data

US 2022/0331928 A1 Oct. 20, 2022

(30) Foreign Application Priority Data

Feb. 27, 2020 (CN) ..... 202010123479.3

(51) Int. Cl.
*B24B 13/00* (2006.01)

(52) U.S. Cl.
CPC ..... *B24B 13/0006* (2013.01)

(58) Field of Classification Search
CPC ..... B24B 13/0006; B24B 1/002; B24B 1/005; B24B 13/06; B24B 31/003; B24B 31/102;
(Continued)

(56) References Cited

U.S. PATENT DOCUMENTS 5,076,026 A * 12/1991 Mizuguchi ..... B24B 13/00 451/36
5,157,871 A * 10/1992 Gawa ..... B24B 41/044 451/5

* cited by examiner

*Primary Examiner* — Laura C Guidotti
*Assistant Examiner* — Caleb Andrew Holizna
(74) *Attorney, Agent, or Firm* — Wang Law Firm, Inc.

(57) ABSTRACT

Disclosed is a device for polishing an intraocular lens by using an electrorheological effect. The device comprises a supporting plate (14), an electric motor (16), a conductive slip ring (18), an outer sleeve (20), a tool shaft (22), a connecting flange (24), an annular electrode (26) and a tool needle (28). The electric motor (16), an outer ring of the conductive slip ring (18), and the outer sleeve (20) are all installed on the supporting plate (14). The electric motor (16) drives the tool shaft (22) to rotate by means of a transmission assembly. One end of the tool shaft (22) is closely fitted with an inner ring of the conductive slip ring (18), and the other end of the tool shaft extends into the outer sleeve (20). The connecting flange (24) is installed on the outer sleeve (20). The annular electrode (26) is connected to the connecting flange (24). One end of the tool needle (28) is connected to the tool shaft (22), and the other end of the tool needle extends out of the annular electrode (26). The tool needle is used as a cathode and the annular electrode is used as an anode in the apparatus. The apparatus thus has a good insulation effect and both tool needle and annular electrode can be detached and adjusted, such that different polishing requirements can be met, and high-quality deterministic polishing for an aspherical intraocular lens can be completed. Further the present invention provides a method for polishing an intraocular lens by using an electrorheological effect.

10 Claims, 4 Drawing Sheets

(58) Field of Classification Search
CPC ... B24B 31/112; B24B 37/015; B24B 37/045; B24B 37/042; B24B 47/10; B24B 47/12; B24B 47/225; B24B 49/105; B24B 55/02; B24B 55/03; B24B 57/02; B24B 31/116; B24B 57/04
USPC ..... 451/42, 36, 104, 113, 294, 488, 908
See application file for complete search history.

APPARATUS AND METHOD FOR POLISHING INTRAOCULAR LENS BY UTILIZING ELECTRORHEOLOGICAL EFFECT

TECHNICAL FIELD

The present invention relates to a technical field of ultra-precision polishing, and particularly relates to an apparatus and method for polishing an intraocular lens by utilizing an electrorheological effect.

BACKGROUND ART

An intraocular lens (IOL) is an intraocular lens implanted in an eye, which can replace a natural lens. The intraocular lens comprises a round optical part and a supporting loop, and is mostly made of acrylate. The diameter of the optical part is generally about 5.5-6 mm. Cataract surgery has gone through needle extraction, intracapsular cataract extraction, extracapsular cataract extraction and small-incision extracapsular cataract extraction, and nowadays has developed into phacoemulsification and intraocular lens implantation that are widely used today, which is inseparable from the research and application of the intraocular lens.

At present, most intraocular lenses are made of acrylate, which is low in stiffness; and the qualification rate of products is only 30% or even lower. This has become an internationally recognized problem in the intraocular lens processing technology. The current manufacturing method of the intraocular lens mainly includes injection molding and turnery. The surface roughness and optical performance are mainly obtained by polishing optical surfaces. However, because the material of the intraocular lens is soft, the existing polishing method (such as finger polishing and mechanical contact polishing) has the problems such as blade grains, over-polishing and the like caused by poor polishing conditions, which seriously affects the optical performance and production efficiency of the intraocular lens.

The electrorheological polishing is a precision processing technology and is a novel polishing method based on an electrorheological effect. Electrorheological fluid is composed of solid particles (a dispersed phase) with high dielectric constant, liquid (a continuous phase) with good insulation performance and polishing abrasive particles. The viscosity of the electrorheological fluid increases with the increase of the density of an electric field under the action of the high-voltage electric field, and shows obvious shear yield resistance. The phenomenon of rapid and reversible change of the electrorheological fluid under the action of the electric field is usually called electrorheological effect.

At present, the electrorheological polishing equipment has the problems of being mostly used for fixed-point polishing, and imperfect insulation measures, etc. Therefore, in view of difficulty in polishing the intraocular lens, it is urgent to provide an apparatus and method for polishing the intraocular lens by utilizing the electrorheological effect.

SUMMARY OF THE INVENTION

The purpose of the present invention is to provide an apparatus and method for polishing an intraocular lens by utilizing an electrorheological effect.

To this object, an embodiment of the present invention adopts the following technical solution:

The present invention provides an apparatus for polishing an intraocular lens by utilizing an electrorheological effect. The apparatus includes a rotary tool. The rotary tool includes a supporting plate, a motor, a conductive slip ring, an outer sleeve, a tool shaft, a connecting flange, an annular electrode and a tool needle. The motor, an outer ring of the conductive slip ring and the outer sleeve all are installed on the supporting plate. The motor drives the tool shaft to rotate through a transmission assembly. One end of the tool shaft is tightly matched with an inner ring of the conductive slip ring, and the other end of the tool shaft extends into the outer sleeve. The connecting flange is installed on the outer sleeve. The annular electrode is connected with the connecting flange. One end of the tool needle is connected with the tool shaft, and the other end of the tool needle extends out of the annular electrode.

In one or more embodiment of the present invention, the annular electrode is connected with a positive electrode of a high-voltage DC power supply, and the conductive slip ring is connected with a negative electrode of the high-voltage DC power supply.

In one or more embodiment of the present invention, the transmission assembly includes a first synchronous belt pulley, a second synchronous belt pulley and a synchronous belt connecting the first synchronous belt pulley and the second synchronous belt pulley; the first synchronous belt pulley is installed on an output shaft of the motor; and the second synchronous belt pulley is installed on the tool shaft.

In one or more embodiment of the present invention, a retaining ring is installed in the outer sleeve; the tool shaft is provided with a first step; the tool shaft is provided with a deep groove ball bearing; and two shaft ends of the deep groove ball bearing are respectively abutted against the retaining ring and the first step.

In one or more embodiment of the present invention, the tool shaft is provided with a second step; a pair of angular contact bearings is installed on the tool shaft; and the other end of the tool shaft is in threaded connection with a locking nut.

In one or more embodiment of the present invention, the annular electrode is provided with a central through hole along an axial direction; and a gap between the wall of the central through hole and the outer wall of the tool needle is 1-2 mm.

In one or more embodiment of the present invention, one end of the tool needle passes through the central through hole and is in threaded connection with the tool shaft.

In one or more embodiment of the present invention, the outer wall of the annular electrode is in threaded connection with the inner wall of the connecting flange.

In one or more embodiment of the present invention, the apparatus is also provided with a liquid nitrogen cooling system, and the liquid nitrogen cooling system is used to cool the intraocular lens.

In an aspect, the present invention also provides a method for polishing an intraocular lens by utilizing an electrorheological effect. The method includes the following steps:

(1) positioning the intraocular lens in a processing trough, pouring prepared electrorheological fluid into the processing trough, adjusting a rotary tool to form a gap between the other end of the tool needle and the introcular lens, and immersing the other end of the tool needle in the electrorheological fluid; (2) spraying liquid nitrogen to the intraocular lens by utilizing a liquid nitrogen cooling system; (3) turning on a high-voltage DC power supply, and adjusting the voltage to 1500-3000 V; (4) starting a motor, adjusting a rotation speed of a tool needle to 1500-3000 r/min, and simultaneously enabling the rotary tool to reciprocate along a Y-axis direction; and (5) ending the polishing, turning off the high-voltage DC power supply and the motor, stopping the movement of the tool needle, and taking out the intraocular lens.

The present invention has the following beneficial effects:

(1) According to the present invention, the apparatus based on the electrorheological effect can be combined with a multi-degree-of-freedom numerical control machine tool according to a set movement mode so as to realize micro removal of surface material of the intraocular lens, thereby achieving a polishing effect.

(2) The tool needle serving as a cathode and the annular electrode serving as an anode both are detachable and adjustable; different polishing requirements can be met by adjusting the gap between the cathode and the anode, the diameter of the tool needle, a thickness of the annular electrode and a length of the other end of the tool needle extending out of the annular electrode; and the application range is wide, the polishing effect is improved, and the production cost is reduced.

(3) The apparatus according to the present invention adopts a separating structure; the synchronous belt is used to transmit the power, thereby isolating the input and output, preventing high-voltage power from being transmitted to the motor and the numerical control machine tool; and the whole apparatus has good insulation effect.

(4) By arranging the conductive slip ring, the intertwining problem of wires caused by the rotation can be solved.

(5) The apparatus of the present invention is compact in structure and convenient to apply the electric field, and not only can polish conductor-type workpieces, but also can polish non-conductor workpieces.

(6) The apparatus of the present invention provides a novel method utilizing the electrorheological effect to polish the intraocular lens, which is intended to realize the ultra-precision polishing on the aspheric intraocular lens, so that the deterministic polishing of the high-quality aspheric intraocular lens becomes possible.

BRIEF DESCRIPTION OF THE DRAWINGS

To more clearly describe the technical solutions in the embodiments of the present invention or in the prior art, the drawings required to be used in the description of the embodiments or in the prior art are simply presented below. Apparently, the following drawings show some embodiments of the present invention, so for those ordinary skilled in the art, other drawings can also be obtained according to these drawings without contributing creative labor.

DETAILED DESCRIPTION OF THE INVENTION

Figure 1:
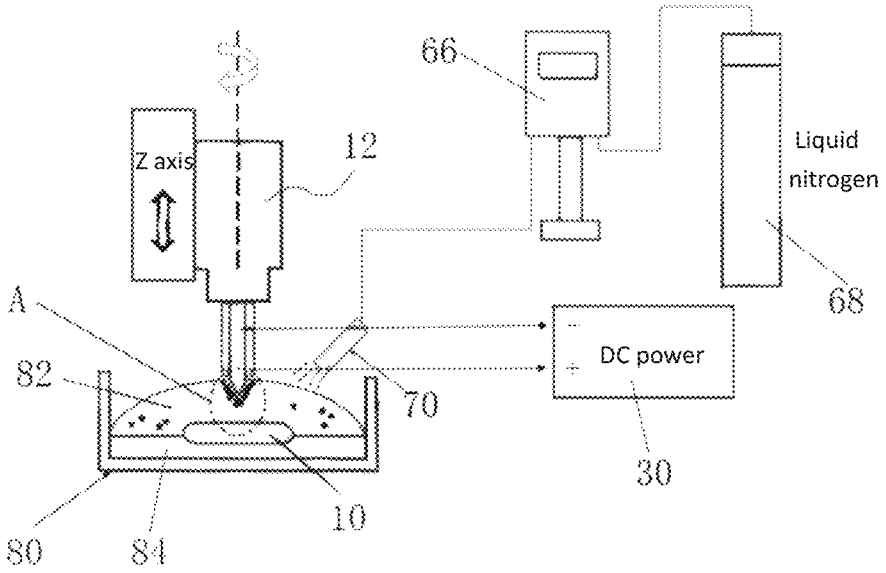
FIG. 1 is a structure schematic view of a preferred embodiment of the present invention.
Figure 2:
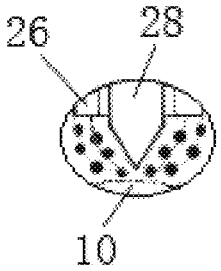
FIG. 2 is an enlarged schematic view of part A in FIG. 1.
Figure 3:
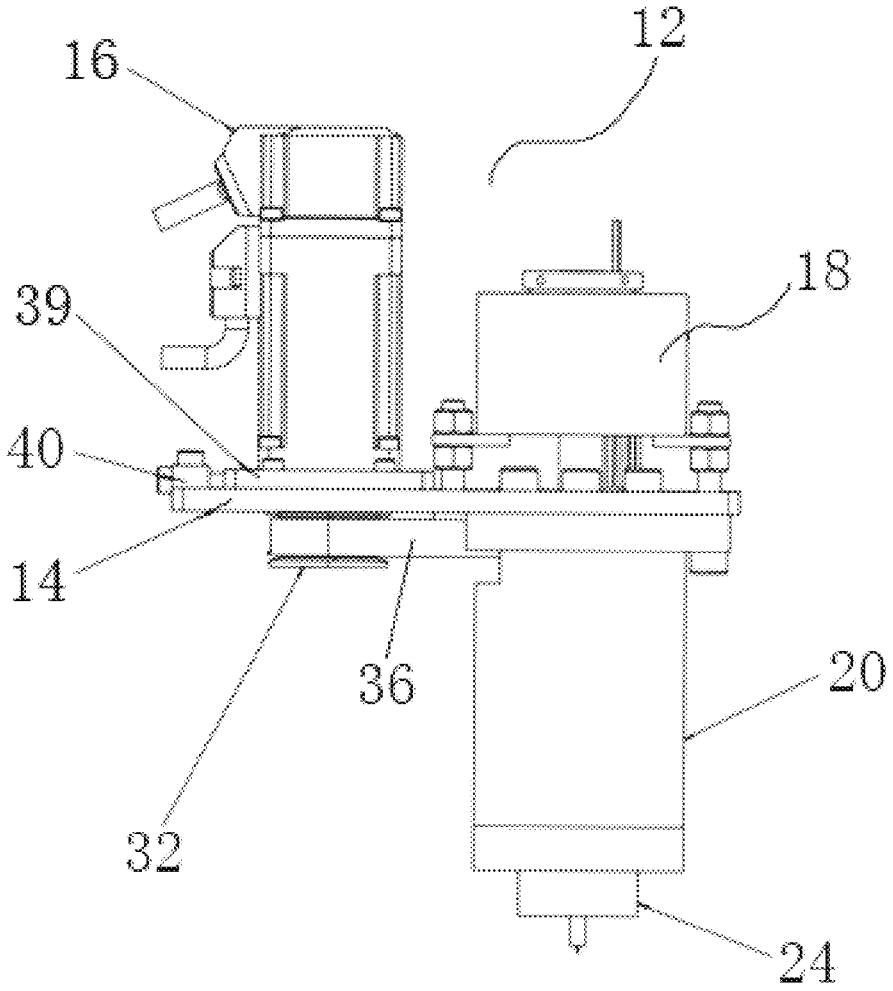
FIG. 3 is a structure schematic view of a rotary tool of a preferred embodiment of the present invention.
Figure 4:
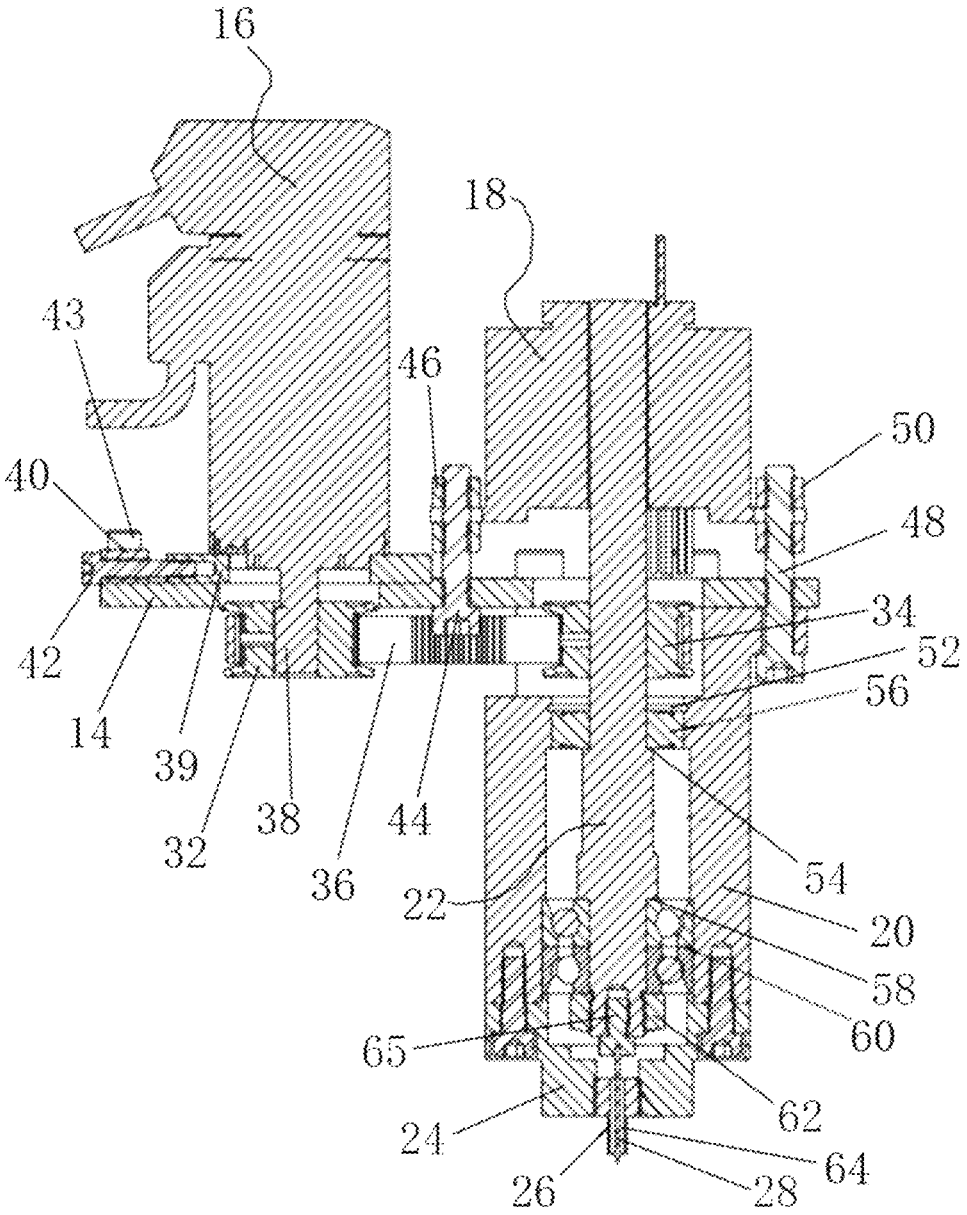
FIG. 4 is a section view of the rotary tool of a preferred embodiment of the present invention.

To make those skilled in the prior art better understand the technical solutions in the present invention, the technical solutions in embodiments of the present invention are clearly and completely described in combination with accompanying drawings in embodiments of the present invention. Apparently, the described embodiments are merely some embodiments of the present invention, not all embodiments. Based on embodiments of the present invention, all other embodiments obtained by those skilled in the art without creative labor shall fall within the protection scope of the present invention.

As shown in FIGS. 1-4, an apparatus for polishing an intraocular lens 10 by utilizing an electrorheological effect includes a rotary tool 12. The rotary tool 12 includes a supporting plate 14, a motor 16, a conductive slip ring 18, an outer sleeve 20, a tool shaft 22, a connecting flange 24, an annular electrode 26 and a tool needle 28. The motor 16, an outer ring of the conductive slip ring 18 and the outer sleeve 20 all are installed on the supporting plate 14. The motor 16 drives the tool shaft 22 to rotate through a transmission assembly. One end of the tool shaft 22 is tightly pressed upon an inner ring of the conductive slip ring 18. The inner ring of the conductive slip ring 18 can rotate together with the tool shaft 22 and can transmit power on the conductive slip ring 18 onto the tool shaft 22. The other end of the tool shaft 22 extends into the outer sleeve 20. The connecting flange 24 is installed on the outer sleeve 20. The annular electrode 26 is connected with the connecting flange 24. One end of the tool needle 28 is connected with the tool shaft 22; and the other end of the tool needle 28 extends out of the annular electrode 26.

In an embodiment of the present invention, the annular electrode 26 is connected with a positive electrode of a high-voltage DC power supply 30, and the conductive slip ring 18 is connected with a negative electrode of the high-voltage DC power supply 30.

Preferably, the transmission assembly includes a first synchronous belt pulley 32, a second synchronous belt pulley 34 and a synchronous belt 36 connecting the first synchronous belt pulley 32 and the second synchronous belt pulley 34. The first synchronous belt pulley 32 is installed on an output shaft 38 of the motor 16, and the second synchronous belt pulley 34 is installed on the tool shaft 22. To ensure the synchronous movement of the first synchronous belt pulley 32 and the second synchronous belt pulley 34, the end surface of the first synchronous belt pulley 32 is preferably parallel to the end surface of the second synchronous belt pulley 34.

To facilitate the adjustment of a tension degree of the synchronous belt 36, a movable sliding plate 39 is preferably installed on the supporting plate 14. The motor 16 is installed on the movable sliding plate 39; the output shaft 38 of the motor 16 passes through the movable sliding plate 39 and the supporting plate 14. The motor 16 is driven to move by the movement of the movable sliding plate 39, thereby adjusting the synchronous belt 36. Further, a stopper 40 is installed on the supporting plate 14. An adjusting screw 42 is unscrewed from the stopper 40 and screwed into the movable sliding plate 39. Because the stopper 40 is fixed on the supporting plate 14, the adjusting screw 42 is rotated to drive the movable sliding plate 39 to move. In the present embodiment, preferably, the stopper 40 is in threaded connection with the supporting plate 14 through a locking screw 43. The stopper 40 and the supporting plate 14 are connected in a detachable connection mode, thereby saving the material. However, the connection is not limited to the above mode, and the stopper 40 and the supporting plate 14 can also be integrated.

In an embodiment of the present invention, the outer ring of the conductive slip ring 18 is fixed to the supporting plate 14 through a first bolt 44, a first nut 46, a second bolt 48 and a second nut 50. Further, the second bolt 48 also passes through the outer sleeve 20 to fix the outer sleeve 20 and the supporting plate 14.

Preferably, a retaining ring 52 is installed in the outer sleeve 20; the tool shaft 22 is provided with a first step 54; the tool shaft 22 is provided with a deep groove ball bearing 56; two shaft ends of the deep groove ball bearing 56 are respectively abutted against the retaining ring 52 and the first step 54; and the perpendicularity of the tool shaft 22 is improved through the deep groove ball bearing 56, thereby ensuring the tool needle 28 and the annular electrode 26 are consistent in co-axiality.

To further improve the co-axiality of the tool needle 28 and the annular electrode 26, the tool shaft 22 is preferably provided with a second step 58. A pair of angular contact bearings 60 is installed on the tool shaft 22; the other end of the tool shaft 22 is in threaded connection with a locking nut 62; the pair of angular contact bearings 60 is positioned by the cooperation of the second step 58 and the locking nut 62; and by arranging the angular contact bearings 60, the perpendicularity of the tool shaft 22 can be improved.

Preferably, the annular electrode 26 is provided with a central through hole 64 along an axial direction; and a gap between the wall of the central through hole 64 and the outer wall of the tool needle 28 is 1-2 mm. Preferably, the gap between the wall of the central through hole 64 and the outer wall of the tool needle 28 is 1.5 mm. One end of the tool needle 28 passes through the central through hole 64 and is in threaded connection with the tool shaft 22; the tool needle 28 is detachably connected with the tool shaft 22, so that the tool needle 28 with different diameters can be replaced easily, and the gap between the outer wall of the tool needle 28 and the central through hole 64 can be adjusted easily; and a length of the tool needle 28 extending out of the annular electrode 26 can be adjusted, which is convenient to adapt to different processing requirements and has wide application range. Specifically, a screw 65 is fixed on one end of the tool needle 28, and the screw 65 is in threaded connection with the tool shaft 22.

Preferably, the outer wall of the annular electrode 26 is in threaded connection with the inner wall of the connecting flange 24; and the annular electrode 26 can be removed from the connecting flange 24 and can be replaced with an annular electrode with different thicknesses, so that the gap between the wall of the central through hole 64 of the annular electrode 26 and the outer wall of the tool needle 28 can be adjusted to adapt to different processing requirements, thereby having wide application range.

As shown in FIG. 1, the apparatus is also provided with a liquid nitrogen cooling system 66. The liquid nitrogen cooling system 66 adopts a conventional technology, which is not repeated here. The liquid nitrogen cooling system 66 is used to cool the intraocular lens 10. Prior to the polishing and in the polishing process, a low-temperature cooling field is provided for the intraocular lens 10, so that the intraocular lens 10 has good stiffness and hardness, and the polishing quality is improved. Specifically, the liquid nitrogen cooling system 66 is connected respectively with a liquid nitrogen tank 68 and a spray nozzle 70. The liquid nitrogen in the liquid nitrogen tank 68 is cooled by the liquid nitrogen cooling system 66 and then sprayed to the intraocular lens 10 through the spray nozzle 70.

Preferably, the tool shaft 22, the annular electrode 26 and the tool needle 28 all are made of martensitic stainless steel.

Preferably, the outer sleeve 20 and the connecting flange 24 both are made of nylon, thereby further improving the overall insulation of the apparatus.

Preferably, the other end of the tool needle 28 is a needlelike tip, which is convenient for polishing the small-sized intraocular lens, thereby improving the polishing quality.

Since the length of the tool needle 28 extending out of the annular electrode 26 can be adjusted, that is, a distance between the needlelike tip of the tool needle 28 and the surface of the intraocular lens 10 can be adjusted; because the distance may affect the intensity of the electric field, the closer the surface of the intraocular lens 10 to the needlelike tip of the tool needle 28, the higher the intensity of the electric field, the more apparent the electrorheological effect, and the higher the shear yield resistance of the electrorheological fluid 82, thereby meeting different polishing requirements, and improving the polishing efficiency and the polishing quality.

A method of the present invention is described below. A method for polishing an intraocular lens by utilizing an electrorheological effect includes the following steps:

(1) An intraocular lens 10 is positioned in a processing trough 80, prepared electrorheological fluid 82 is poured into the processing trough 80, a rotary tool 12 is adjusted to form a gap between the other end of the tool needle 28 and the intraocular lens 10, and the other end of the tool needle 28 is immersed in the electrorheological fluid 82. As a preferable solution, a clamp 84 is arranged in the processing trough 80 so as to position the intraocular lens 10. In the present embodiment, the clamp 84 is a sucker, but is not limited to the sucker, and may also be an air source adsorption or a vacuum generator. The surface of the intraocular lens is in an aspheric convex shape; by adjusting a numerical control machine tool, a gap between the other end of the tool needle 28 and a highest point of the convex surface of the intraocular lens 10 is not greater than 1 mm, thereby ensuring the good polishing effect and electric field intensity.

(2) A liquid nitrogen cooling system 66 is used to spray liquid nitrogen to the intraocular lens 10. As a preferred solution, the liquid nitrogen is sprayed to the intraocular lens 10 through a spray nozzle 70, so that a temperature of the intraocular lens 10 is stabilized below the vitrification temperature.

Figure 5:
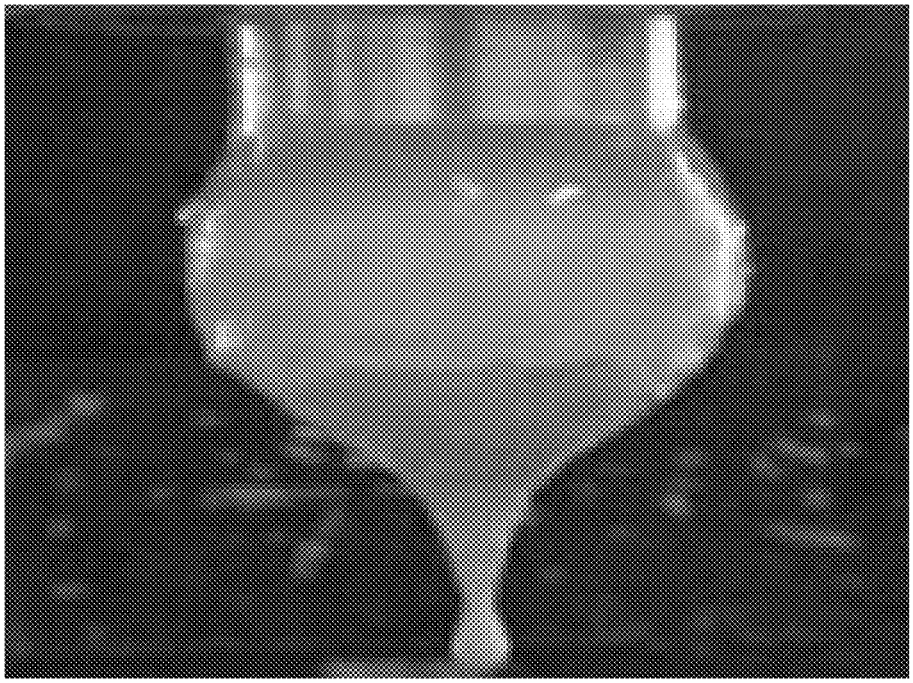
FIG. 5 is a view of a flexible polishing head formed during polishing of a preferred embodiment of the present invention.

(3) A high-voltage DC power supply 30 is turned on, the voltage is adjusted to 1500-3000 V, and a high-voltage electric field is formed between the tool needle 28 and the annular electrode 26; the electrorheological fluid 82 generates an electrorheological effect; the flow of the electrorheological fluid has properties of a Bingham medium; and polishing abrasive particles are aggregated at the other end of the tool needle 28 to form a soft flexible polishing head, as shown in FIG. 5. As a preferred solution, the voltage is adjusted to 3000 V.

(4) A motor 16 is started, a rotation speed of the tool needle 28 is adjusted to 1500-3000 r/min, and simultaneously, a rotary tool 12 is driven to reciprocate along a Y-axis direction, wherein the Y-axis direction refers to the Y-axis direction of the numerical control machine tool; and the abrasive particles in the flexible polishing head are driven to remove tiny amounts of materials on the surface of the intraocular lens 10, thereby realizing the polishing. As a preferred solution, by setting the numerical control machine tool, a reciprocating speed of the rotary tool 12 along the Y-axis direction is 0.5-2 mm/s, and a reciprocating stroke is 10 mm. As a preferred solution, a rotation speed of the tool needle 28 is adjusted to 2000 r/min, and simultaneously, a reciprocating speed of the rotary tool 12 along the Y-axis direction is 1 mm/s. Preferably, a maximal outer diameter of the annular electrode 26 is 5 mm; the diameter of the flexible polishing head formed after the electrorheological effect is generated is greater than 5 mm; and the diameter of an aspheric optical part of the intraocular lens 10 is about 5 mm, so that the flexible polishing head can well cover the surface of the intraocular lens 10. An X axis of the numerical control machine tool is previously adjusted; during the polishing, the rotary tool 12 is stationary in the X-axis direction; and the reciprocating stroke of the rotary tool 12 along the Y-axis direction is 10 mm, thereby improving the polishing quality.

(5) The polishing is ended, the high-voltage DC power supply 30 and the motor 16 are turned off; and the tool needle 28 is stopped moving, and the intraocular lens 10 is taken out.

It is apparent for those skilled in the art that the present invention is not limited to the details of the above exemplary embodiments, and that the present invention can be implemented in other specific forms without departing from the spirit or basic characteristics of the present invention. Therefore, the embodiments should be regarded as exemplary and non-limiting from any point of view, and the scope of the present invention is defined by the appended claims rather than the above description, so that all changes falling within the meaning and scope of equivalents of the claims shall be contained in the present invention. Any reference numerals in the claims should not be regarded as limiting the claims involved.

Furthermore, it should be understood that although this specification is described according to the embodiments, each embodiment does not include only one independent technical solution. The description of the specification is only for the sake of clarity. Those skilled in the art should take the specification as a whole, and the technical solutions in each embodiment can be combined appropriately to form other embodiments that can be understood by those skilled in the art.

What is claimed is:

1. An apparatus for polishing an intraocular lens by utilizing an electrorheological effect, comprising a rotary tool, the rotary tool including;

a supporting plate;

a motor mounted on the supporting plate;

a conductive slip ring having an inner ring and an outer ring, the outer ring being installed on the supporting plate;

an outer sleeve installed on the supporting plate;

a tool shaft driven by the motor through a transmission assembly, one end of the tool shaft tightly contacting the inner ring of the conductive slip ring, and the other end of the tool shaft extending into the outer sleeve;

a connecting flange installed on the outer sleeve;

an annular electrode connected with the connecting flange; and a tool needle, one end of which is connected with the tool shaft, and the other end of which extends out of the annular electrode.

2. The apparatus for polishing the intraocular lens by utilizing the electrorheological effect according to claim 1, wherein the annular electrode is connected with a positive electrode of a high-voltage DC power supply, and the conductive slip ring is connected with a negative electrode of the high-voltage DC power supply.

3. The apparatus for polishing the intraocular lens by utilizing the electrorheological effect according to claim 1, wherein the transmission assembly comprises a first synchronous belt pulley, a second synchronous belt pulley and a synchronous belt connecting the first synchronous belt pulley and the second synchronous belt pulley; the first synchronous belt pulley is installed on an output shaft of the motor; and the second synchronous belt pulley is installed on the tool shaft.

4. The apparatus for polishing the intraocular lens by utilizing the electrorheological effect according to claim 1, wherein a retaining ring is installed in the outer sleeve; the tool shaft is provided with a first step and a deep groove ball bearing; and two ends of the deep groove ball bearing are respectively abutted against the retaining ring and the first step.

5. The apparatus for polishing the intraocular lens by utilizing the electrorheological effect according to claim 4, wherein the tool shaft is provided with a second step; a pair of angular contact bearings is installed on the tool shaft; and the other end of the tool shaft is in threaded connection with a locking nut.

6. The apparatus for polishing the intraocular lens by utilizing the electrorheological effect according to claim 1, wherein the annular electrode is provided with a central through hole along an axial direction; and a gap between the wall of the central through hole and the outer wall of the tool needle is 1-2 mm.

7. The apparatus for polishing the intraocular lens by utilizing the electrorheological effect according to claim 6, wherein one end of the tool needle passes through the central through hole and is in threaded connection with the tool shaft.

8. The apparatus for polishing the intraocular lens by utilizing the electrorheological effect according to claim 1, wherein the outer wall of the annular electrode is in threaded connection with the inner wall of the connecting flange.

9. The apparatus for polishing the intraocular lens by utilizing the electrorheological effect according to claim 1, further comprising a liquid nitrogen cooling system used to cool the intraocular lens.

10. A method for polishing an intraocular lens by utilizing an electrorheological effect and by using the apparatus of claim 1, the method comprises the following steps:

(1) positioning the intraocular lens in a processing trough, pouring prepared electrorheological fluid into the processing trough, adjusting a rotary tool to form a gap between the other end of the tool needle and the introcular lens, and immersing the other end of the tool needle in the electrorheological fluid;

(2) spraying liquid nitrogen to the intraocular lens by utilizing a liquid nitrogen cooling system;

(3) turning on a high-voltage DC power supply, and adjusting the voltage to 1500-3000 V;

(4) starting a motor, adjusting a rotation speed of a tool needle to 1500-3000 r/min, and simultaneously enabling the rotary tool to reciprocate along a Y-axis direction; and (5) ending the polishing, turning off the high-voltage DC power supply and the motor, stopping the movement of the tool needle, and taking out the intraocular lens.

* * * * *